United States Patent [19]

Watts

[11] Patent Number: 4,838,323

[45] Date of Patent: Jun. 13, 1989

[54] MISFUELLING PREVENTION DEVICE AND METHOD

[75] Inventor: Andrew J. Watts, Ince (Nr. Chester), United Kingdom

[73] Assignee: Shell Oil Company, Houston, Tex.

[21] Appl. No.: 175,812

[22] Filed: Mar. 31, 1988

Related U.S. Application Data

[63] Continuation of Ser. No. 46,370, May 6, 1987, abandoned.

[30] Foreign Application Priority Data

May 16, 1986 [GB] United Kingdom ..... 8612020

[51] Int. Cl.[4] ..... B65B 1/04; B65B 1/30

[52] U.S. Cl. ..... 141/1; 141/83; 141/311 R; 340/632

[58] Field of Search ..... 141/1, 5, 83, 94, 95, 141/98, 311 R, 351; 340/603, 632

[56] References Cited

U.S. PATENT DOCUMENTS

| | | | |
|---|---|---|---|
| 4,153,085 | 5/1979 | Adams | 141/311 R |
| 4,469,149 | 9/1984 | Walkey et al. | 141/94 |
| 4,572,254 | 2/1986 | Maeshiba | 141/98 |
| 4,576,137 | 3/1986 | Tanaka | 123/575 |
| 4,590,903 | 5/1986 | Hofmann et al. | 123/300 |
| 4,590,904 | 5/1986 | Wannenwetsch | 123/300 |
| 4,594,201 | 6/1986 | Phillips et al. | 261/18 B |
| 4,594,968 | 6/1986 | Degobert et al. | 123/1 A |
| 4,597,369 | 8/1986 | Yasuhara | 123/458 |
| 4,603,662 | 8/1986 | Norton et al. | 123/1 A |
| 4,603,674 | 8/1986 | Tanaka | 123/575 |
| 4,606,322 | 8/1986 | Reid et al. | 123/575 |
| 4,611,567 | 9/1986 | Covey | 123/545 |
| 4,612,881 | 9/1986 | Tsujimura | 123/27 GE |
| 4,612,905 | 9/1986 | Dietrich et al. | 123/575 |
| 4,619,240 | 10/1986 | Bedford et al. | 123/575 |

FOREIGN PATENT DOCUMENTS

| | | | |
|---|---|---|---|
| 204981 | 5/1986 | Fed. Rep. of Germany . | |
| 2502134 | 9/1982 | France | 141/94 |
| 1229407 | 5/1986 | U.S.S.R. . | |

*Primary Examiner*—Ernest G. Cusick

[57] ABSTRACT

A system for preventing the accidental addition of automotive diesel fuel to the fuel tank of a gasoline fuelled vehicle at retail filling stations. The vapor pressure in the tank to be filled is measured by sensors and the difference in vapor pressure between gasoline and diesel fuels is used to give a safety cut-off system.

16 Claims, 1 Drawing Sheet

MISFUELLING PREVENTION DEVICE AND METHOD

RELATED APPLICATION

This is a continuation of application Ser. No. 046,370, filed May 6, 1987, now abandoned.

BACKGROUND OF THE INVENTION

The invention relates to a misfuelling prevention device. Such a device acts to stop a specific fuel from being accidentally added to the fuel tank of an engine which has not been developed for such specific fuel. For example, such a device acts to stop automotive diesel fuel from being accidentally added to the fuel tank of a gasoline-fuelled vehicle at a retail filling station.

Diesel fuel is being used in increasing quantities by the private motorist, who can now choose a compression-ignition engine as an option with many cars. This has encouraged changes in the siting of delivery pumps at retail stations, and whereas previously the diesel pump would be remotely situated it will now often be found next to its gasoline counterparts. The motorist must make an active decision as to which pump to select when purchasing fuel, and failure to do so could result in misfuelling. The principal problem arises with the drivers of conventional gasoline-fuelled vehicles who draw up to diesel pumps unaware that any fuel other than gasoline is available; the converse problem of drivers attempting to put gasoline into diesel tanks is much rarer, presumably because the drivers of diesel-fuelled vehicles, who are in the minority, are most accustomed to being selective in their refuelling. This problem at best, causes considerable disruption to the business of the retail station, and at worst could damage a customer's vehicle, resulting in a claim for repairs.

There are several ways in which this problem could be tackled. A direct alternative would be to ensure physical incompatibility between, for example, the fillers of gasoline and diesel cars, so that the nozzle of a diesel pump simply could not be used to refill a gasoline vehicle. This, however, would require the participation of third parties, certainly the vehicle manufacturers to ensure that common standards are agreed upon and enforced. Another possibility would be to include a sensor to sample the contents of the fuel tank before filling to confirm that the fuel is compatible before allowing fresh fuel to be dispensed.

Therefore, it is an object of the invention to provide a simple and convenient method and system for misfuelling prevention which can be used as a safeguard against the accidental misfuelling of automotive or other engines, which is becoming more common with the increased use of fuels other than gasoline for vehicles, and which causes great inconvenience and possibly engine damage.

SUMMARY OF THE INVENTION

The invention provides a method for preventing the misfuelling of a fuel tank comprising the steps of connecting a fuel delivery pump to the tank to be filled, measuring a quantity representative of the ydrocarbon vapor pressure above the fuel (such as a volume of air containing hydrocarbon vapor) in the tank before delivery of the fuel, comparing the value of the said measured quantity with a predetermined value, deriving from this comparison information concerning the kind of fuel in the tank and disconnecting the fuel delivery pump before filling if the fuel in the tank is different from the fuel to be supplied by the delivery pump.

The invention also provides an apparatus for preventing the misfuelling of a fuel tank comprising means for connecting a fuel delivery pump to the tank to be filled, means for measuring a quantity representative of the hydrocarbon vapor pressure above the fuel in the tank before delivery of the fuel, means for comparing the value of the said measured quantity with a predetermined value, means for deriving from this comparison information concerning the kind of fuel in the tank and means for disconnecting the delivery pump before filling if the fuel in the tank is different from the fuel to be supplied by the delivery pump.

The invention is based upon the recognition that the vapor pressure difference between different fuels, such as gasoline and diesel fuel, provides a physical parameter which can be measured using modern sensors to give a safety cut-off system.

The vapor above gasoline is predominantly butane, and has a partial pressure of at least 3.6 psi (generally 5.8–7.3 psi). That above diesel may contain a wider spread of hydrocarbons, but is at a very much lower partial pressure of perhaps 0.15 psi maximum and typically 0.015 psi. There is thus at least an order of magnitude difference in the hydrocarbon concentration above diesel compared with that above gasoline. A sensor system could thus be based simply upon hydrocarbon concentration rather than on the precise mix of hydrocarbon components. The tank atmosphere would be sampled before delivery of fuel, and a high hydrocarbon reading, indicating that the tank already contains gasoline, for example, would disable the pump. A simple method of disabling the fuel delivery would be to interrupt the electrical supply to the fuel delivery pump, and only turn it on when the sensor system had registered an all clear.

DESCRIPTION OF THE DRAWING

The invention will now be described by way of example in more detail with reference to the accompanying FIG. 1, which represents schematically the system of the invention.

DETAILED DESCRIPTION OF THE INVENTION

Figure 1:
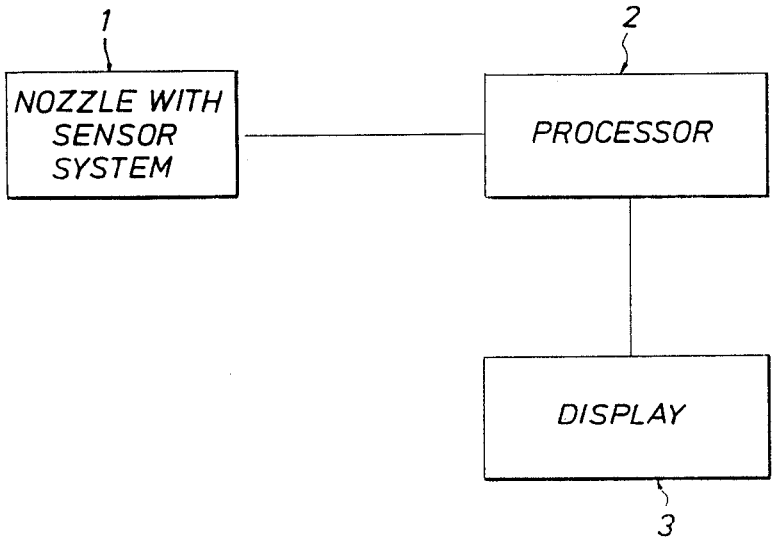

Block 1 represents a nozzle with a sensor system 1 which is capable of measuring and determining the hydrocarbon vapor pressure in a tank to be filled after a diesel fuel delivery pump has been connected to the tank. For reasons of clarity the tank and diesel delivery pump have not been shown.

The sensor system 1 is connected by any suitable means to a processing means 2 comprising means for comparing the measured value of the vapor pressure in the tank to be filled with a predetermined value. From this comparison information can be derived concerning the kind of fuel in the tank.

The processing means 2 can be connected by any suitable means to a display means 3 for displaying the measured value of the vapor pressure. The display means 3 can be located on any suitable location.

If the measured value of the vapor pressure is above a predetermined value, for example, which means that the tank to be filled already contains gasoline and that the diesel delivery pump erroneously has been connected to a gasoline fuel tank, the pump is disconnected before filling. The pump can be disconnected in any way suitable for the purpose.

The sensor system can be constructed in several advantageous manners. For example, the atmosphere of the tank to be filled can be sampled via a tube (an "aspirated" system) or the sensor itself can be located on the filler nozzle of the delivery pump, such that it samples the tank atmosphere directly. An aspirated system would require a tube fed to the end of the filler nozzle, through which gas is drawn through the sensor system using a pump. An alternative to an aspirated system is the siting of a sensor element close to the end of the filler nozzle, in order directly to sample the tank atmosphere. The advantages of such an approach would be that no delay associated with passage of sampled gas down an aspirating tube would occur.

It will be appreciated that any sensor means suitable for the purpose can be used, and that the method and system of the invention can also be used for prevention of misfuelling a diesel fuel tank with gasoline. When a diesel fuel tank erroneously is connected to a gasoline delivery pump, the pump will be disconnected if the measured value of the vapor pressure is below a predetermined value, which means that the tank already contains diesel fuel.

It will also be appreciated that the present invention is not restricted to gasoline-diesel misfuelling prevention for automotive engines, but can be used for any engines and any fuels having mutually different vapor pressures, such as jet fuel-aviation gasoline misfuelling of airplane engines.

Various modifications of the present invention will become apparent to those skilled in the art from the foregoing description and accompanying drawing. Such modifications are intended to fall within the scope of the appended claims.

I claim:

1. A method of preventing the misfuelling of a fuel tank, said tank containing a first fuel therein, said method comprising the steps of connecting a fuel delivery pump to the tank, said delivery pump being adapted to deliver a second fuel from the pump to the tank, measuring a parameter representative of the hydrocarbon vapor pressure above the fuel in the tank before the second fuel is delivered from the pump to the tank, comparing the value of said measured parameter with a predetermined value, deriving from this comparison information concerning the kind of fuel in the tank, determining that the fuel in the tank is different from the fuel to be delivered by the delivery pump, and disconnecting the delivery pump before the second fuel is delivered from the pump to the tank, said disconnecting step being in response to said determining step.

2. The method as claimed in claim 1 wherein the delivery pump is disconnected if the value of the said measured parameter is above the predetermined value.

3. The method as claimed in claim 1 wherein the delivery pump is disconnected if the value of the said measured parameter is below the predetermined value.

4. The method as claimed in any one of claims 1, 2, or 3, including displaying the value of the said measured parameter.

5. The method as claimed in any one of claims 1, 2, or 3, including measuring the parameter representative of the hydrocarbon vapor pressure above the fuel in the tank by sampling the atmosphere of the tank.

6. The method as claimed in any one of claims 1, 2, or 3, including measuring the parameter representative of the hydrocarbon vapor pressure above the fuel in the tank by sampling the atmosphere of the tank via a tube.

7. The method as claimed in any one of claims 1, 2, or 3, including measuring the parameter representative of the hydrocarbon vapor pressure above the fuel in the tank wherein said parameter is measured by a sensor.

8. The method as claimed in any one of claims 1, 2, or 3, including measuring the parameter representative of the hydrocarbon vapor pressure above the fuel in the tank, wherein said parameter is measured by a sensor located on a filler nozzle of the delivery pump.

9. An apparatus for preventing the misfuelling of a fuel tank comprising means for connecting a fuel delivery pump to the tank to be filled, means for measuring a parameter representative of the hydrocarbon vapor pressure above the fuel in the tank before delivery of the fuel, means for comparing the value of the said measured parameter with a predetermined value, means for deriving from this comparison information concerning the kind of fuel in the tank, and means for disconnecting the delivery pump before filling if the fuel in the tank is different from the fuel to be supplied by the delivery pump.

10. The apparatus as claimed in claim 9 wherein the means for disconnecting the delivery pump before filling is operative if the value of the said measured parameter is above the predetermined value.

11. The apparatus as claimed in claim 9 wherein the means for disconnecting the delivery pump, before filling is operative if the value of the said measured parameter is below the predetermined value.

12. The apparatus as claimed in any one of claims 9, 10, or 11, additionally including a means for displaying the value of the said measured parameter.

13. The apparatus as claimed in any one of claims 9, 10, or 11, additionally including a means for sampling the atmosphere in the tank.

14. The apparatus as claimed in any one of the claims 9, 10, or 11, additionally including a means for displaying the value of the said measured parameter and a means for sampling the atmosphere in the tank.

15. The apparatus as claimed in any one of claims 9, 10, or 11, additionally including a means for sampling the atmosphere in the tank, wherein said means for sampling comprises a tube which is fed to the end of the filler nozzle of the delivery pump.

16. The apparatus as claimed in any one of claims 9, 10, or 11, additionally including a means for sampling the atmosphere in the tank, wherein said means for sampling comprises a sensor means located on the filler nozzle of the delivery pump.

* * * * *